United States Patent [19]

Bobbitt

[11] 4,068,445

[45] Jan. 17, 1978

[54] LIGHTWEIGHT, SCREW ANCHOR SUPPORTED FOUNDATION AND METHOD OF INSTALLING SAME

[75] Inventor: Donald E. Bobbitt, Centralia, Mo.

[73] Assignee: A. B. Chance Company, Centralia, Mo.

[21] Appl. No.: 660,434

[22] Filed: Feb. 23, 1976

Related U.S. Application Data

[63] Continuation-in-part of Ser. No. 550,753, Feb. 18, 1975, abandoned.

[51] Int. Cl.[2] ..... E04D 15/00; E02D 27/00

[52] U.S. Cl. ..... 52/743; 52/157; 52/296; 264/34

[58] Field of Search ..... 52/296, 292, 299, 742, 52/743, 98, 154, 155–166, 169, 170, 153; 61/50; 264/34

[56] References Cited

U.S. PATENT DOCUMENTS

| | | | |
|---|---|---|---|
| 2,234,907 | 3/1941 | Williams | 52/157 |
| 2,799,369 | 7/1957 | Walton | 52/157 |
| 2,826,281 | 3/1958 | Johnson | 52/158 |
| 2,864,633 | 12/1958 | Mackie | 52/157 |
| 3,076,532 | 2/1963 | Frye | 52/157 |
| 3,135,097 | 6/1964 | Scheinberg | 61/50 |
| 3,371,902 | 3/1968 | Hartwick | 52/157 |
| 3,426,109 | 2/1969 | Dempster | 264/34 |
| 3,626,702 | 12/1971 | Monahan | 52/169 |
| 3,676,965 | 7/1972 | Deike | 52/98 |
| 3,694,978 | 10/1972 | Mintz | 52/704 |

FOREIGN PATENT DOCUMENTS

| | | | |
|---|---|---|---|
| 135,117 | 11/1919 | United Kingdom | 52/296 |

*Primary Examiner*—Price C. Faw, Jr.
*Assistant Examiner*—Robert C. Farber
*Attorney, Agent, or Firm*—Schmidt, Johnson, Hovey & Williams

[57] ABSTRACT

A lightweight, easily installable, anchored foundation for electrical equipment or the like is provided which includes a foam-filled, force-transmitting frusto-conical housing tensionably connected to a plurality of adjacent, buried earth anchors having remote load-bearing helices thereon in order to create a prestressed bulb of relatively compacted soil between the housing base and anchor helices which greatly enhances the holding power of the foundation under both tension and compression loads. In preferred forms the foundation exhibits approximately the same support strength as poured concrete, but can be more quickly installed and employed at remote locations or on loose soil which would normally preclude the use of concrete. In preferred forms, the housing is substantially buried and external foam fill is deposited about the base of the housing to absorb any transverse loads, and force-transmitting internal housing ribs are provided which serve to transmit tension forces from the earth anchors to the supported structure. An installation method is also disclosed which includes positioning the housing within an augered hole proximal to embedded earth anchors, attaching the latter to the housing in a manner to tensionably pull the housing base and anchor helices in opposition to each other for creation of a compacted soil bulb, foam filling the housing and the exterior volume adjacent the base thereof, and refilling the hole with earth to substantially bury the foundation.

6 Claims, 4 Drawing Figures

Fig.4.
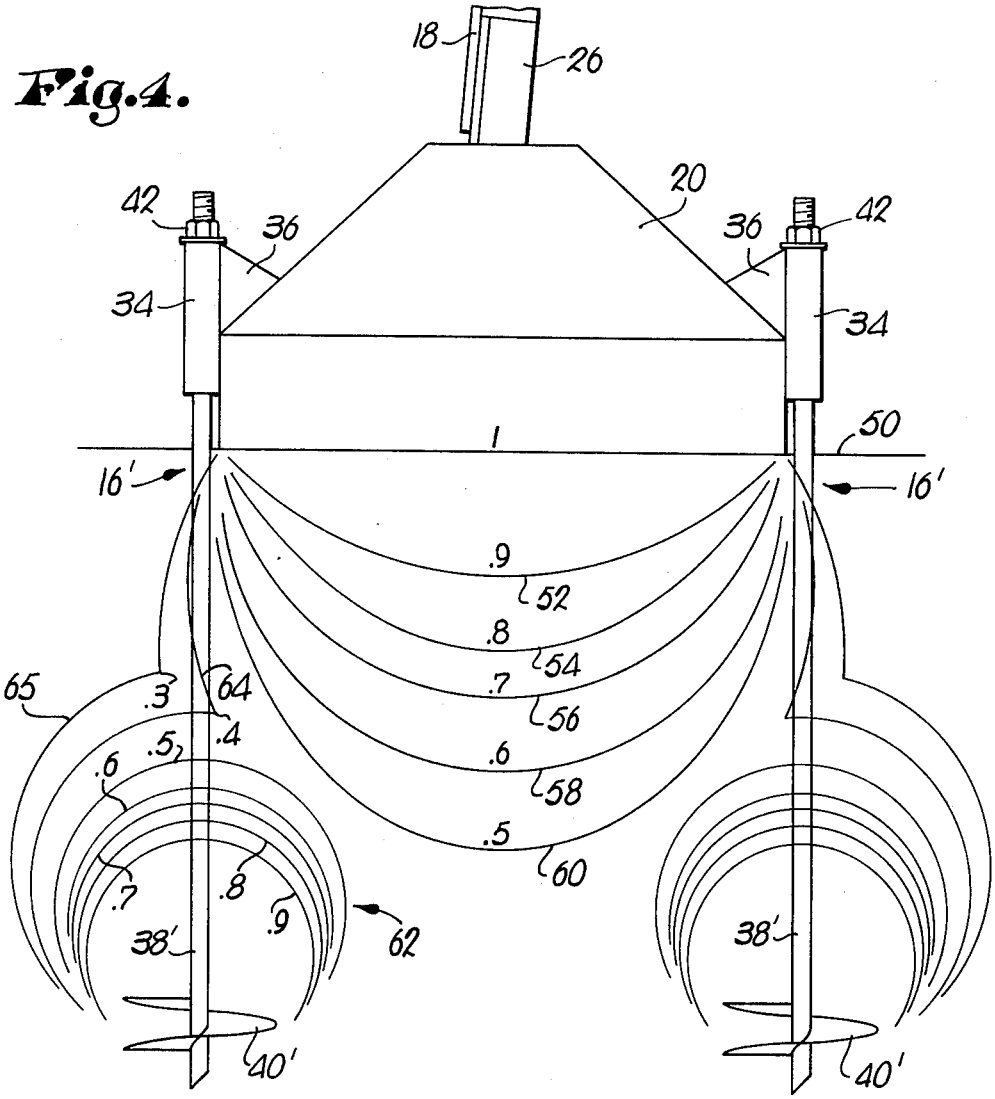
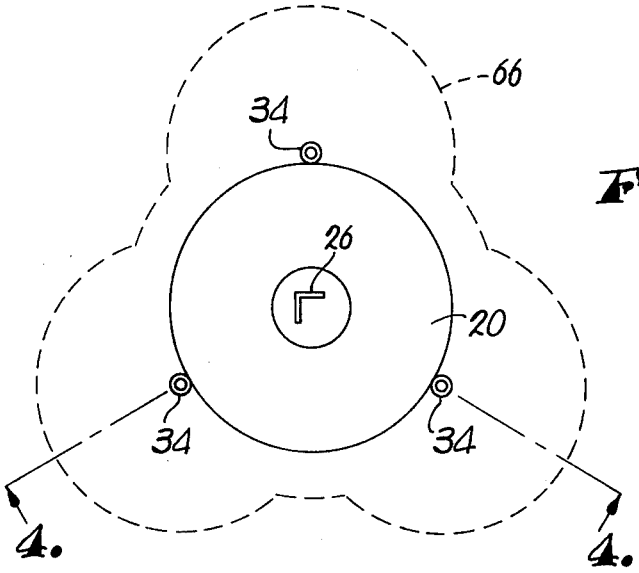
Fig.3.

LIGHTWEIGHT, SCREW ANCHOR SUPPORTED FOUNDATION AND METHOD OF INSTALLING SAME

This is a continuation-in-part of identically titled application Ser. No. 550,753, filed Feb. 18, 1975, now abandoned.

This invention relates to a lightweight earth foundation, as well as a method of installing the same, wherein the foundation is especially adapted for use in supporting upright, above ground electrical transmission towers and the like and is characterized by the properties of safely withstanding all types of loading on the tower and being easily installable at remote location or on loose, sandy soils which normally preclude the employment of poured-in-place concrete foundations. More particularly, it is concerned with a foundation assembly preferably mounted below-grade and including force-transmitting structure in the form of a housing tensionably coupled to a plurality of spaced, embedded earth anchors of the type having remote transverse load-bearing helices or the like in order to prestress the foundation soil and create a relatively compacted bulb thereof between the anchor helices and housing base.

It is conventional practice in the electrical industry to provide long overhead transmission and distribution lines extending from the power station to the ultimate user. Such lines are normally supported by upright poles or tower constructions, but the latter are especially common with transmission lines spanning relatively long distances. Electrical towers of this type have heretofore been supported by poured-in-place concrete footings which generally serve as an adequate foundation and are able to withstand the compression and tension loads imposed upon the towers due to high wind or other ambient weather conditions.

However, poured-in-place concrete foundations can be very difficult and expensive to construct in heavily wooded areas or the like where the right-of-way has not been cleared. In some instances the equipment and materials must be airlifted by means of a helicopter to the tower site. In other cases, loose or sandy soil conditions militate against the use of concrete foundations, since soils of this type will generally not support both the concrete foundation and the supported tower. Moreover, although it has been suggested to employ lightweight, prefabricated slabs or the like as foundations, these do not in general have sufficient holding power to adequately support relatively massive electrical towers or the like.

It is therefore the most important object of the present invention to provide a foundation for electrical transmission towers or the like which is light in weight and easily installable at remote or heavily wooded locations, notwithstanding the fact that the foundation is capable of supporting the normal compression and tension loads experienced by the electrical tower and has substantially the same structural integrity as a poured-in-place concrete foundation.

Another object of the invention is to provide a lightweight, force-spreading foundation which includes force-transmitting structure such as a housing having an earth-contacting base, a plurality of buried earth anchors having remote, generally transversely extending load-bearing members such as helices thereon, and connecting means for tensionably coupling the housing and earth anchors for pulling the latter into opposition with the housing base; this coupling creates a relatively compacted, prestressed bulb of soil between the anchors and base which is effective for markedly enhancing the holding power of the foundation against tension and compression loads experienced in practice. In preferred forms, the anchors are coupled so that they are placed only under tension in operation in order to ensure that no voids are built up at the helix areas thereof stemming from slight up-down movements of the earth anchor, as could occur if the anchor were subjected to both tension and compression loading.

Another important object of the invention is to provide a foundation of the type described which is adapted to be mounted below-grade and includes a hollow housing having sloping sidewalls and is supported by embedded earth anchors, the housing being filled with an initially flowable synthetic resin foam which hardens to present substantially rigid, load-bearing fill so that the characteristic forces imposed on the foundation by a supported electrical tower can be safely handled even in loose or otherwise undesirable soils.

A still further object of the invention is to provide a hollow, substantially open bottom housing so that initially flowable fill material deposited in the housing comes into direct contact with the earthen support surface; this precludes the formation of voids at the interface between the fill and earthen surface which can collect water and lessen the holding power of the foundation.

As a corollary to the foregoing, it is also an object of the invention to provide a substantially rigid foam fill exteriorly of the housing in order that any transverse or shearing loads experienced by the supported tower can be safely transmitted to the earth without fear of overloading or uprooting the foundation.

A still further object of the invention is to provide a foundation wherein the housing includes an upper frustoconical section having a plurality of internal, integral, force-transmitting ribs which are operable to transmit tension forces from the embedded earth anchors to the supported electrical tower such that the latter is able to withstand all ambient wind and weather conditions normally encountered in use.

FIG. 3 is an essentially schematic plan view of a foundation in accordance with the invention, illustrated as it would appear installed in the earth, with the outline of the prestressed bulb of relatively compacted soil appearing in dotted lines; and FIG. 4 is an essentially schematic, vertical sectional view taken along line 4—4 of FIG. 3 and illustrating the stress isobars created in the soil between the anchor helices and housing base.

Figure 1:
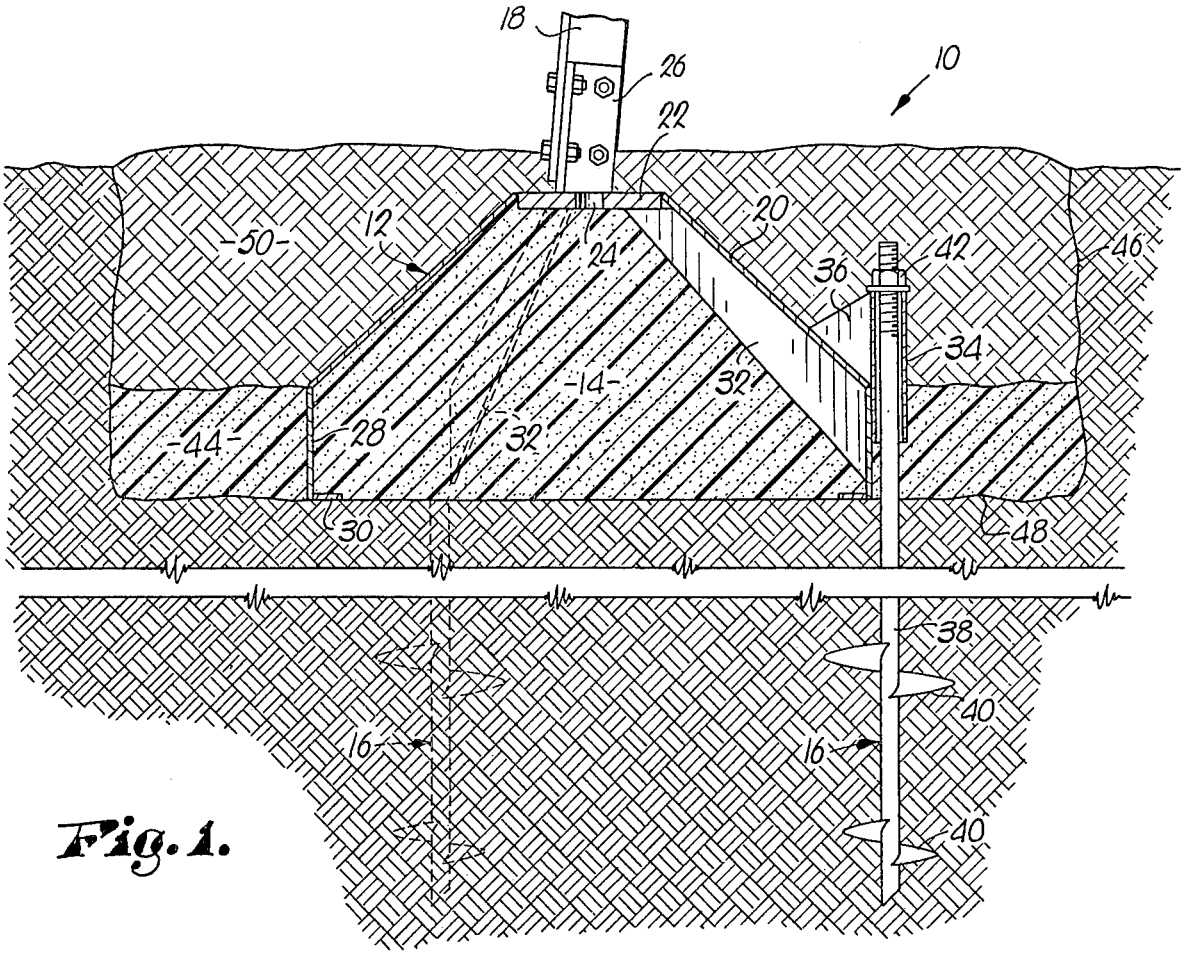
FIG. 1 is a fragmentary view in partial vertical section illustrating the foundation of the present invention installed in the earth and supporting one leg of an upright electrical transmission tower.
Figure 2:
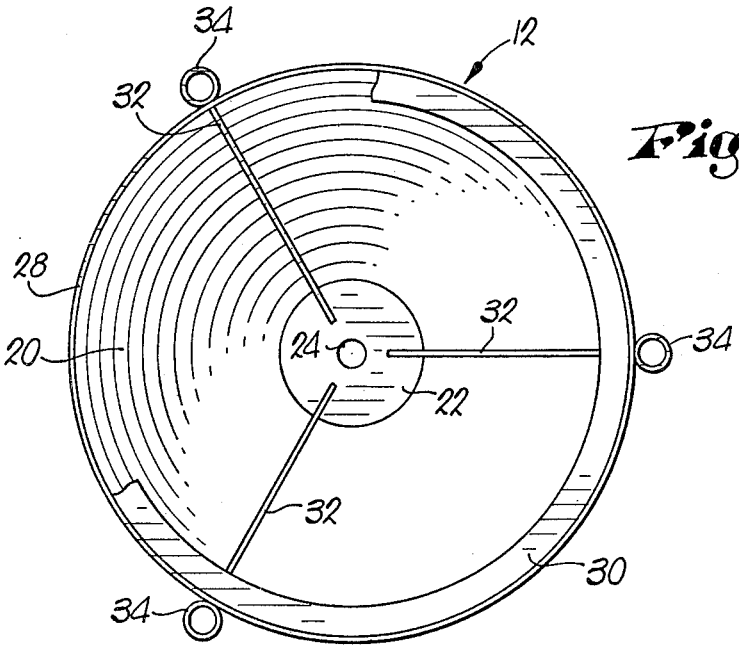
FIG. 2 is a bottom view of the hollow, generally frustoconical housing section of the foundation, with a portion of the lower lip thereof broken away for clarity.

Foundation 10 of the present invention is shown in its environment of use in FIG. 1 and broadly includes upper force-transmitting structure in the form of an initially hollow, substantially open-bottom metallic housing 12 supported below-grade within an augered hole 46. Housing 12 is filled with a substantially rigid, load-bearing foam fill 14 and is tensionably connected to a plurality of spaced earth anchors 16 embedded in the earth therebeneath. One leg 18 of a conventional electrical transmission tower is shown fragmentarily in the Figure, the leg being supported at the upper end of foundation 10. As illustrated, each anchor 16 includes a pair of remote, generally transversely extending load-bearing members in the form of helices 40, which is important for purposes to be made clear hereinafter.

Referring again to FIG. 1, it will be seen that housing 12 includes a generally frustoconical upper section 20 terminating in a generally flat top plate 22 having a foam injection port 24 therethrough. In addition, top plate 22 has an upright angle 26 secured thereto for the purpose of facilitating attachment of leg 18 to the foundation. A continuous, depending sidewall section 28 is integrally attached to upper section 20, and section 28 terminates in a lowermost, inwardly extending annular flange or lip 30. A series of elongated, obliquely oriented, force-transmitting ribs 32 are integrally attached along the internal surface of upper section 20 and are also connected at the ends thereof to top plate 22 and sidewall section 28 respectively.

A plurality of elongated, upright tubular elements 34 are attached to the exterior of sidewall section 28 at the approximate location of the lowermost connection of ribs 32. The connection of elements 34 to housing 12 is secured by provision of gussets 36 extending between upper section 20 and the elements 34.

Each earth anchor 16 is of the conventional variety and includes an elongated shaft 38 and one or more single flight, load-bearing helices 40 attached thereto adjacent the lowermost end of the anchor. As illustrated in FIG. 1, the uppermost ends of the anchors are received in corresponding elements 34 and are tensionally coupled to housing 12 by means of nut assemblies 42. In this regard it should be noted that the anchors 16 are connected to housing 12 so that the anchors experience essentially only tension loads during use of foundation 10. This results from the absence of structure connected to shafts 38 and engaging the lower end of the elements 34 which would serve to transmit compressive loads to the anchors and especially the helices 38 thereof.

Foam fill 14 is an initially liquid, injectable composition which hardens upon setting to present a load-bearing bottom surface for foundation 10. In this connection it will be seen in FIG. 1 that fill 14 completely fills the interior volume of housing 12. In addition, a generally annular section 44 of the foam material is in surrounding relationship to the housing about depending sidewall section 28. The purpose of fill 14 is to present a bottom surface for housing 12 which is adapted to intimately contact the earthen surface 48 of hole 46 so as to preclude formation of voids that can trap water or the like. Of course, by virtue of the fact that housing 12 is of substantially open-bottom configuration and the foam fill is injected as a liquid, the bottom foam surface of the foundation is formed so as to closely conform to earthen surface 48.

In practice, it has been found that any one of a number of synthetic resin foam materials are usable in the present invention; for example, the polyurethane or polystyrene foams. In preferred forms however, the hardened foam should have a compressive strength of at least about 1000 psi (at 5% deflection). Such a compressive strength may be obtained through the use of a high density foam or a lower density foam filled with glass beads or a like filler material.

As briefly explained above, an important feature of the present invention stems from the formation of a prestressed bulb of soil beneath the foundation housing which increases the overall holding capacity of foundation 10. In essence, provision of means for creating such an enlarged bulb of soil effectively spreads the compressive and tensile forces experienced by the foundation over a much larger area than that occupied by housing 12 alone. Thus the effective size of the foundation is increased, along with the holding power thereof.

Turning to FIG. 4, housing 12 is depicted in engagement with an earthen surface 50 and coupled to earth anchors 16'. Each anchor 16' includes an elongated shaft 38' and a single load-bearing helix 40' adjacent the lower end of the shaft. Coupling of the anchors 16' is accomplished by way of nut assemblies 42 threaded onto the shafts 38' and engaging the upper ends of the tubular elements 34. A study of FIG. 4 will make it clear that the anchors 16', and thus the helices 40', are under tension and are in effect pulled in opposition to the base of housing 12 resting on earthen surface 50. The extent of tensioning between housing 12 and the anchors 16' is of course determined by torque executed on nut assemblies 42 during installation thereof and the type of soil. In any event, tensioned coupling of the anchors 16' creates, in cooperation with the opposed housing 12, a relatively compacted, prestressed bulb of soil 66 (see FIG. 3) between the helices 40' and the housing base. As explained, this bulb of soil serves to measurably enhance the holding power of the overall foundation, since the bulb is of greater transverse dimensions than that of housing 12.

In order to explain the phenomenon of soil bulb creation in greater detail, exemplary stress isobars or contour lines of equal stress have been added to FIG. 4. In particular, if the stress line at the point of contact between the base of housing 12 and surface 50 is taken to be unity, then housing stress isobars 52–60 define contours of stress which are progressively lower in value as indicated. At the same time however, the helix 40' of each anchor 16' creates its own series of stress isobars 62 which decrease in magnitude with increasing distance from the helix. Thus, at a certain point the stress isobars extending from the housing and the respective helices merge and cooperatively present a continuous, isovalue stress bar or line (e.g., see lines 64, FIG. 4). In three dimensional terms, the bulb 66 can be thought of as a theoretical solid about the axis of housing 12. All soil within the bulb would be stressed or compacted at a level greater than or equal to a given outer isovalue surface, while the soil outside the bulb would be at a lesser stress level. Of course, isovalue surfaces of lesser magnitude would be generated outside of line 64, e.g., at line 65.

The outline of an exemplary bulb of soil 66 created by housing 12 and anchors 16' is shown in plan in FIG. 3 with the three equally spaced enlarged areas representing the location of stress lines generated at the anchor helices. Although illustrative in nature, it should be understood that the depicted isovalue stress lines which define soil bulb 66 may not accurately represent the bulb developed in actual practice, since many empirical factors such as soil type, degree of tensioning, and helix size and position will affect the effective size and shape of the soil bulb created.

In the installation of foundation 10 in normal soils, the following preferred procedure is normally followed. First, a hole 46 is augered into the earth to present an excavation having a below-grade lower surface 48 for contact with the underside of housing 12 and fill 14. As illustrated in FIG. 1, hole 46 is of a depth permitting complete burial of the housing with only angle 26 projecting above grade. In addition, the diameter of hole 46 is such that housing 12 can be positioned therein and leave a substantial space between the housing and the sidewalls of the hole. This is to provide sufficient area for fabrication of annular foam section 44.

The next step involves screwing the anchors 16 into the earth at spaced, predetermined locations so that the upper threaded protruding ends thereof will be received by the elements 34 attached to housing 12. At this point, housing 12 is lowered onto the earth anchors and the foundation initially oriented by means of a mounting template (not shown) to ensure that angle 26 is properly oriented to receive tower leg 18. This in some instances requires that shims be inserted beneath the housing to properly position the latter. At this point nut assemblies 42 are tightened onto the upper end of the anchor shafts.

An initially liquid foam fill is next injected into housing 12 through port 24 to completely fill the interior of the housing. As noted, housing 12 is of substantially open bottom configuration so that the injected fill material comes into direct, intimate contact with the underlying earthen support surface. In addition, exterior foam section 44 is also poured at this time to present a substantially continuous foam fill throughout the interior and exterior of housing 12. After hardening of the liquid foam composition, the nut assemblies are torqued to a desired degree. As explained, this tensioned coupling between housing 12 and earth anchors 16 creates the desirable bulb of prestressed soil which enhances the holding power of the foundation. Of course the nuts 42 can be tightened as necessary for this purpose. At this point, the hole 46 is backfilled with earth 50 and the foundation is ready to receive tower leg 18 and support the same.

In soft clay soils the loading capacity of foundation 10 may be improved by preloading the foundation and allowing the soil to consolidate sufficiently to sustain the anticipated load prior to erecting the structure on the foundation. In practice, the foundation is fabricated as described and the nut assemblies 42 torqued to predetermine loads at given intervals, based upon laboratory consolidation tests. When the soil is consolidated to present a desired bulb of prestressed soil beneath the housing, the excavation is backfilled to complete the foundation. The foundation is then ready for reception of the tower leg as described above.

When foundation 10 has been installed in the earth as described, a portion of the compressive load experienced is transmitted through the sloped, converging wall defining the generally frustoconical upper section 20 of housing 12 to the below-grade surface 48 of hole 46. The majority of such forces however, are transmitted through rigid foam fill 14 which, by virtue of the intimate contact thereof with the underlying earthen surface, causes such compression forces to be evenly spread over a relatively large area, thus ensuring that the foundation remains operable even on sandy or loose soils. In fact, it has been determined that only approximately 20% of the compressive loads are normally carried through metallic housing 12, while fill 14 serves to transmit the remainder thereof. However, of prime importance is the fact that the prestressed bulb of soil beneath the housing allows the compressive forces to be dissipated over a much larger area than that presented by housing 12 itself.

Any transverse or shearing loads imposed upon the tower superstructure are transmitted primarily through upper section 20 to the external, annular fill section 44. Although such shearing loads are relatively minor in comparison with the compressive and tensile loads (i.e., approximately 1/10 as large) provision of the annular, external fill section 44 ensures that foundation 10 can absorb such loads without fear of uprooting or other untoward results. In addition, by virtue of the fact that the fill material is in direct contact with surface 48 through the open bottom of housing 12, no water can collect at this interface which can reduce the holding power of the foundation.

Finally, the internal ribs 32 are provided for effectively transmitting the tension forces imposed on the tower superstructure by the embedded anchors 16. As can be appreciated, it is necessary to not only support a relatively large tower construction against settling into the earth, but also to prevent uprooting or movement thereof caused by high wind conditions and the like. Hence, ribs 32 are particularly advantageous in transmitting these requisite tensile holding forces from the embedded earth anchors.

In preferred forms of the invention the embedded earth anchors 16 are coupled to the housing 12 in a manner to experience essentially only tensile forces, while being substantially isolated from compression loads imposed on the foundation. This is believed advantageous since formation of voids adjacent the anchor helices is avoided by this method of coupling. Voids could be created by slight upward and downward movement of the anchor helices during alternate compression and tension load bearing, but this possibility is precluded by the coupling means of the present invention.

In practice, it has been found that a foundation 10 in accordance with the invention exhibits approximately the same strength characteristics as a poured-in-place concrete foundation. However, it will be readily apparent that the latter is much heavier and harder to install, particularly on loose soils or in remote locations.

Having thus described the invention, what is claimed as new and desired to be secured by Letters Patent is:

1. A method of installing a foundation comprising the steps of:

driving a plurality of spaced earth anchors into the earth at a selected foundation site, each of said anchors including an elongated shaft and a generally transversely extending load-bearing member adjacent the lower embedded end of the shaft;

positioning force-spreading structure adjacent said anchors with the base thereof contacting the earth and presenting a first effective area; and tensionally coupling said earth anchors and force-spreading structure in a manner to pull said base and load-bearing members in opposition to each other for creating a prestressed bulb of soil between the base and load-bearing members, the greatest effective horizontal cross-sectional area of said bulb of soil being greater than said first effective area of said base for spreading compressive and tensile loads imposed on said foundation in order to increase the holding power of said foundation, said coupling including the steps of successively pulling said base and load-bearing members in opposition to each other a plurality of times at desired intervals for creating said bulb of soil.

2. The method as set forth in claim 1 wherein said coupling includes the step of coupling said anchors for substantially isolating said load-bearing members from compressive loads experienced by said foundation.

3. The method as set forth in claim 1 wherein said force-transmitting structure includes a hollow, substantially open bottom housing, and including the steps of filling said housing with an initially flowable material, and allowing said material to harden to present a substantially rigid, load-bearing fill.

4. The method as set forth in claim 3 including the steps of digging a hole into the earth to present a below-grade earthen surface, driving said anchors into said surface and positioning the base of said force-transmitting structure on said surface between said anchors.

5. The method as set forth in claim 4 including the step of placing an initially flowable material exteriorly of said housing in surrounding relationship to said housing base and between the walls of the housing and the defining walls of said hole, and allowing said material to harden and become substantially rigid and load-bearing.

6. The method as set forth in claim 5 including the step of filling said hole with backfill material after said initially flowable material has hardened.

* * * * *